US010312619B2

(12) United States Patent
Lubeley et al.

(10) Patent No.: US 10,312,619 B2
(45) Date of Patent: Jun. 4, 2019

(54) CONTACT SLEEVE FOR PLUG-AND-SOCKET DEVICES

(71) Applicant: AMAD Mennekes Holding GmbH & Co. KG, Kirchhundem (DE)

(72) Inventors: Markus Lubeley, Kirchhundem (DE); Peter Epe, Lennestadt (DE)

(73) Assignee: AMAD Mennekes Holding GmbH & Co. KG, Kirchhundem (DE)

( * ) Notice: Subject to any disclaimer, the term of this patent is extended or adjusted under 35 U.S.C. 154(b) by 0 days.

(21) Appl. No.: 15/569,341

(22) PCT Filed: May 2, 2016

(86) PCT No.: PCT/EP2016/059785
§ 371 (c)(1),
(2) Date: Oct. 25, 2017

(87) PCT Pub. No.: WO2016/184673
PCT Pub. Date: Nov. 24, 2016

(65) Prior Publication Data

US 2018/0316111 A1 Nov. 1, 2018

(30) Foreign Application Priority Data

May 21, 2015 (DE) ..... 10 2015 108 088

(51) Int. Cl.
*H01R 4/48* (2006.01)
*H01R 13/11* (2006.01)
(Continued)

(52) U.S. Cl.
CPC ..... *H01R 13/111* (2013.01); *H01R 13/187* (2013.01); *H01R 43/16* (2013.01); *H01R 2201/26* (2013.01)

(58) Field of Classification Search
CPC .... H01R 13/111; H01R 13/187; H01R 43/16; H01R 2201/26
(Continued)

(56) References Cited

U.S. PATENT DOCUMENTS 429,869 A * 6/1890 Sawyer ..... 104/195
2,303,384 A * 12/1942 Penfold ..... H01R 13/111 439/723
(Continued)

FOREIGN PATENT DOCUMENTS

DE 429869 6/1926
DE 41 12 584 1/1994
(Continued)

OTHER PUBLICATIONS

International Search Report dated Jul. 28, 2016 by the European Patent Office in International Application PCT/Ep2016/059785.

*Primary Examiner* — Abdullah A Riyami
*Assistant Examiner* — Vladimir Imas
(74) *Attorney, Agent, or Firm* — Henry M. Feiereisen LLC

(57) ABSTRACT

A plug-and-socket device includes a plug pin, and a contact sleeve having a cavity extending in a direction of an insertion axis for receiving the plug pin. The contact sleeve includes at least two contact fingers arranged in parallel relationship to one another around the cavity and configured to move elastically apart while expanding the cavity when the plug pin is inserted. At least one of the at least two contact fingers is formed on an inner side in facing relation to the cavity with at least one depression which lies in a contact surface on the inner side and defines with the contact surface an edge angle of less than approx. 100°. The contact
(Continued)

surface represents on the inner side of the contact finger a surface which comes into contact with the plug pin, when the plug pin is inserted.

11 Claims, 3 Drawing Sheets

(51) Int. Cl.
*H01R 43/16* (2006.01)
*H01R 13/187* (2006.01)

(58) Field of Classification Search
USPC ..... 439/816, 851
See application file for complete search history.

(56) References Cited

U.S. PATENT DOCUMENTS 2,318,648 A * 5/1943 Penfold ..... H01R 13/111 439/723
2,346,831 A * 4/1944 Drury ..... H01R 13/18 16/108
2,563,760 A * 8/1951 Uline ..... H01R 13/111 420/494
2,703,872 A * 3/1955 Doane ..... H01R 13/111 439/848
2,813,257 A * 11/1957 Cornell, Jr. ..... H01R 13/111 403/372
2,858,521 A * 10/1958 Young ..... H01R 13/111 439/685
3,170,752 A * 2/1965 Horssen ..... H01R 13/111 24/681
3,564,487 A * 2/1971 Upstone et al. ..... H01R 13/111 439/843
4,002,400 A * 1/1977 Evans ..... H01R 13/111 439/748
4,345,373 A * 8/1982 Lacaze, Jr. ..... H01R 43/16 29/874
4,461,531 A * 7/1984 Davis ..... H01R 43/26 439/843
4,525,013 A * 6/1985 Phillips ..... H01R 24/42 439/578
4,666,227 A * 5/1987 Galizia ..... H01R 13/111 439/252
4,772,233 A * 9/1988 Hoffman ..... H01R 13/18 439/833
4,906,212 A * 3/1990 Mixon, Jr. ..... H01R 13/111 439/857
5,088,942 A * 2/1992 Welsh ..... H01R 43/16 439/843
5,106,329 A 4/1992 Maeshima et al.
5,135,418 A * 8/1992 Hatagishi ..... H01R 13/111 439/851
5,167,543 A * 12/1992 Wurster ..... H01R 13/111 439/851
5,199,910 A * 4/1993 Kahle ..... H01R 13/111 439/843
5,317,664 A * 5/1994 Grabiec ..... G02B 6/3887 385/81
5,413,509 A * 5/1995 Castaldo ..... H01R 13/652 439/851
5,591,039 A * 1/1997 Matthews ..... H01R 13/53 439/181
5,620,347 A * 4/1997 Sawada ..... H01R 13/111 439/851
5,628,656 A * 5/1997 Macioce ..... H01R 13/052 439/851
5,634,829 A * 6/1997 Kerul ..... H01R 13/193 439/842
5,720,634 A * 2/1998 Sten ..... H01R 13/111 439/843
5,857,877 A * 1/1999 Hotea ..... H01R 13/11 439/787
5,921,803 A * 7/1999 Mori ..... B60L 11/1818 439/387
6,186,841 B1 * 2/2001 Jacobsson ..... H01R 13/111 439/851
6,638,116 B2 * 10/2003 Byron ..... H01R 13/18 439/584
6,955,569 B2 * 10/2005 Baker ..... H01R 13/18 439/839
7,249,983 B2 * 7/2007 Meyer ..... H01R 4/185 439/748
7,448,906 B1 * 11/2008 Islam ..... H01R 9/05 439/578
7,467,980 B2 * 12/2008 Chiu ..... H01R 13/18 439/843
7,942,683 B2 * 5/2011 Copper ..... H01R 13/187 439/187
9,017,089 B2 * 4/2015 Flower ..... H01R 4/00 439/345
9,325,095 B2 * 4/2016 Glick ..... H01R 13/187
9,450,322 B2 * 9/2016 Ljubijankic ..... H01R 43/16
9,601,856 B2 * 3/2017 Regantini ..... H02B 11/04
9,787,012 B2 * 10/2017 Kawaguchi ..... H01R 13/03
10,008,800 B2 * 6/2018 Inoue ..... H01R 13/11
2002/0086589 A1 7/2002 Williams
2015/0357738 A1 * 12/2015 Griepenstroh ..... H01R 13/111 439/816

FOREIGN PATENT DOCUMENTS

DE 196 05 206 8/1998
DE 10 2013 100 493 12/2013
EP 1 729 371 12/2006
EP 2 642 604 9/2013
WO WO 2014/111074 7/2014

* cited by examiner

CONTACT SLEEVE FOR PLUG-AND-SOCKET DEVICES

CROSS-REFERENCES TO RELATED APPLICATIONS

This application is the U.S. National Stage of International Application No. PCT/EP2016/059785, filed May 2, 2016, which designated the United States and has been published as International Publication No. WO 2016/184673 and which claims the priority of German Patent Application, Serial No. 10 2015 108 088.5, filed May 21, 2015, pursuant to 35 U.S.C. 119(a)-(d).

BACKGROUND OF THE INVENTION

The invention relates to a contact sleeve for receiving a plug pin in a plug-and-socket device, and to a method for the production of such a contact sleeve.

Contact sleeves are used for example in sockets or receptacles of electric plug-and-socket devices for electric power according to DIN VDE, EN 60309 2 ("CEE plugs) or according to IEC 62196 ("E-vehicle charging plug devices"). They typically have an essentially circular cylindrical cavity for receiving a correspondingly shaped plug pin. For a good and lasting electrical contact, a highest possible contact pressure between the inner side of the contact sleeve and the plug pin should be established. On the other hand, this force must not become too great in order to enable a user to easily plug in and disconnect the plug-and-socket device.

SUMMARY OF THE INVENTION

Against this background, it was an object of the present invention, to provide contact sleeves having both good contact characteristics and good handling capability.

This object is achieved by various methods for the production of contact sleeves in accordance with the present invention as well as by contact sleeves in accordance with the present invention. Advantageous configurations are set forth in the subclaims.

According to a preferred embodiment, the invention is implemented in a method for the production of a contact sleeve. In this case, the contact sleeve has a cavity, extending in the direction of an insertion axis for receiving an associated plug pin in an electrical plug-and-socket device, and it includes at least two contact fingers, which are arranged in parallel relation to one another around the cavity, with the contact finger moving elastically apart while expanding the cavity as the plug pin is inserted. The method is characterized by the steps (which can be carried out in the indicated sequence or any other suitable sequence or simultaneously):

- Drilling and/or milling in a raw material a cavity which extends along an insertion axis and tapers towards the distal end;
- optional drilling and/or milling at least one depression in the inner side of at least one contact finger in facing relation to the cavity;
- forming slots extending in the direction of the insertion axis for exposing contact fingers around the cavity.

The method is able to produce contact sleeves according to independent aspects of the invention, which are described in more detail hereinafter.

According to a first aspect, the invention relates to a contact sleeve with a cavity for receiving an associated plug pin in an electrical plug-and-socket device. The cavity is intended hereby to extend in the direction of a predefined axis, which is referred to in the following as an "insertion axis", since the plug pin moves along this axis during the plug-in process. Furthermore, the "associated" plug pin should involve a predefined plug pin, which matches the dimensions of the cavity. Typically, the plug pin is circular cylindrical with a specified cylinder diameter between 1 mm and 15 mm. The contact sleeve includes the following components:

- At least two webs, tongues or fingers, which are referred to in the following as "contact fingers" and which are arranged parallel to one another around the cavity to thereby bound or define the cavity, with the contact fingers being able to elastically move apart while expanding the cavity, as the plug pin is inserted. All contact fingers are preferably of a same type, but they may also be different.
- At least one depression formed in the inner side of at least one contact finger in facing relationship to the cavity. Preferably, such a depression is located in each of the existing contact fingers. Furthermore, several depressions are advantageously arranged on different contact fingers such that they merge into one another to thereby establish an overall depression which extends across two or more contact fingers.

The described contact sleeve ensures a comfortable plugging while at the same time realize a mechanically secure acceptance of a plug pin and a reliable electrical contacting, since the plug pin is received in the cavity of the contact sleeve by the elastic contact pressure of the contact fingers. The at least one depression on an inner side of the contact fingers assists these properties because of the absence of any contact between the plug pin and the contact sleeve in the region of the depression.

Preferably, the freestanding contact fingers realize the desired contact pressure solely as a result of their elastic properties. Optionally, the compressive force, exerted by the contact fingers upon a plug pin, may also be realized, decreased, or assisted, by other measures. For example, a higher contact pressure can be generated by surrounding the contact fingers on the outside by an elastic spring ring.

The advantages of the invention are attained as soon as a single depression is provided in a single contact finger. The advantages are usually optimized, however, when two or more depressions are arranged behind one another in the direction of the insertion axis, with contact surfaces lying between the depressions for contacting a plug pin inserted into the cavity. Referring in the following to "the depression" always includes also that the respective properties apply for at least one of several depressions, preferably for all existing depressions.

According to a preferred embodiment of the invention, the depression forms with the contact surface on the inner side of the contact finger an edge angle of less than 100° (measured in the material of the contact finger), preferably less than approx. 91°. The "contact surface" shall hereby be the one surface on the inner side of the contact finger, which surface comes into contact with the plug pin when a plug pin is inserted, or approaches the plug pin by less than a predetermined distance, e.g., less than approx. 0.2 mm to approx. 0.3 mm. The described feature means that the depression has at least some areas that are sharp-edged. The edge angle of the depression may, of course, also be considerably more acute than the mentioned degree numbers, although angles of less than 90° are normally difficult to realize.

The edges which form the depression with the contact surface can all be configured identically (La, for example all sharp-edged) or differently. In particular, the edges which are passed first as a plug pin is inserted can be "soft", and the edges that are passed next can be sharp-edged; In this way, removal of the plug pin is realized with as little friction as possible. Furthermore, it is preferred for the described (sharp) edge of the depression to extend at least in some areas transversely in relation to the insertion axis.

In order to be able to develop its desired effect, the depression must, of course, lie in a region of the cavity which receives the plug pin, when the plug-and-socket device is plugged together ("plug-in area"). It is particularly preferred for the depression to lie in the distal half of the cavity, with the "distal" end of the cavity being defined as lying at the end of the cavity, where the opening for insertion of a plug pin is located. The depression may, in particular, lie in the last approx. 30% distal area of the axial extent of the cavity. In other words, the depression is preferably located in the entrance area of the cavity, so as to ensure that effectively the entire length of the plug pin has to pass the depression.

As explained above, the inner side of the contact fingers is divided into "contact surface", which, when the plug-and-socket device is plugged together, contacts a plug pin or approaches the latter by less than a minimum distance, and surface in the region of the depressions, where no contact is made between the material of the contact fingers and a plug pin. According to a preferred embodiment of the invention, these regions of the depression(s) cover between approx. 20% and approx. 80%, preferably between approx. 30% and approx. 70%, of the total area of the inner side (i.e., the remainder is formed by contact surface).

In general, the depression can have any shape. Preferably, at least two depressions are provided on different contact fingers, which jointly form a groove wrapped around the insertion axis.

According to a second, independent aspect, the invention relates to a further contact sleeve which has a cavity extending in direction of an insertion axis for receiving an associated plug pin in an electrical plug-and-socket device, and which includes at least two contact fingers arranged in parallel relation to one another around the cavity, with the contact fingers moving elastically apart while expanding the cavity, when the plug pin is inserted. The contact sleeve according to the second aspect is characterized in that at least one contact finger, when viewed in a section perpendicular to the insertion axis, contacts an associated plug pin at (at least) two points, which are separated by a gap between plug pin and contact finger.

A "gap" shall hereby be present by definition, when the distance between plug pin and contact finger is so great that no electrical current flow takes place (at (mains) voltages of typically below 1000 V occurring in practice). Typically, the gap width is greater than approx. 0.01 mm. Furthermore, the condition usually refers to an associated plug pin with a circular cylindrical shape. The contact sleeve according to the second aspect can, optionally, be configured in one of the afore-described manners (i.e. in particular include a depression in the inner side of at least one contact finger in facing relation to the cavity).

The contact of a plug pin can be effected at exactly two points (in a section plane perpendicular to the insertion axis) or along exactly two axially extending lines (combination of the afore-mentioned points). When all contact fingers are of identical configuration, the total number of contact points or contact lines is then equal to twice the number of contact fingers. In the presence of more than two contact points per contact finger, the total number increases correspondingly.

In the case of the contact sleeve, the contact fingers can again be freestanding or, optionally, can be coupled with additional means, such as, for example, an elastic spring ring wrapped around the outside.

The described contacting at two points can be achieved in various ways. For example, three-dimensional structures with depressions and elevations can be arranged in the inner surface of the contact finger (e.g. by milling or embossing). The contact points could be situated, e.g. on elevated ribs which are formed on the inner surface of the contact finger.

In particular, the contact surface can be frustoconical or circular cylindrical on the inner side of at least one contact finger, with the radius $R_F$ being less than the (nominal) radius $R_S$ of the associated plug pin at at least one axial position (preferably at all axial positions in the distal region of the insertion axis). Typically, the radius of the contact surface is smaller by approx. 5% to approx. 20% than the radius of the plug pin (i.e. $(R_S-R_F)/R_S=0.05$ to 0.2). For geometrical reasons, the mentioned differences in size of the radii of the contact fingers may touch the contact finger at only two points (or lines).

According to a further modification of the afore-described contact sleeves, the inner side of at least one contact finger is coated at least on the contact surfaces, for example with a layer of nickel and/or silver. The core material of the contact fingers or the contact sleeve is typically made of a cost-effective material with good electrical conductivity, such as brass. The mentioned coating provides improved mechanical and/or electrical properties at the contact surfaces. In practice, however, it has been shown that a coating wears off after prolonged use. In the afore-described contacting between contact finger and plug pin at two points, an advantageous supply of coating material is formed in this respect: when coating material wears off in the region of the contact points, the contact points migrate along the gap between them towards one another and remain continuously in contact with coating that has not yet been stripped away.

According to a third, independent aspect, the invention relates to a further contact sleeve which has a cavity extending in direction of an insertion axis for receiving an associated plug pin in an electrical plug-and-socket device, and which includes at least two contact fingers arranged in parallel relation to one another around the cavity, with the contact fingers moving apart elastically while expanding the cavity, when the plug pin is inserted. The contact sleeve according to the third aspect is characterized in that the cavity tapers towards the distal end, with the contact fingers and a carrier body of the contact sleeve to carry the contact fingers being produced from a raw material without bends.

The contact sleeve according to the third aspect can, optionally, be formed in one of the above-described ways (i.e., in particular have a depression in the inner side of at least one contact finger in facing relation to the cavity and/or a contact finger which, viewed in a section perpendicular to the insertion axis, contacts two points which are separated by a gap between plug pin and contact finger).

The tapering of the cavity can in particular be realized by making the cavity essentially cone-shaped (or frustoconical) with a cone radius which increases from the plug-in opening towards the bottom of the cavity.

The contact sleeve can have contact fingers which again can be freestanding or coupled optionally with added means (e.g. spring ring).

A contact sleeve having improved properties can be obtained by means of a material-removing production from a grown material, without bending of the material.

According to another embodiment of all of the afore-described contact sleeves, at least one of the contact fingers can have a variable thickness (measured perpendicular to the insertion axis) along its axial extent. Typically, all contact fingers have the same thickness variations. By varying the thickness, the stability and the elastic behavior of the contact fingers can be adjusted as required, when inserting a plug pin. The thickness of the contact fingers can be realized by changing the radius or the clear width of the cavity, i.e. by a suitable shape of the inner side of the contact fingers. In addition or as an alternative, radius changes can also be present on the outer side of the contact fingers. It is particularly preferred to configure the contact fingers at their proximal end (i.e., in proximity of the carrier body) thicker than at the opposite distal end.

The invention further relates to a method for the production of a contact sleeve with a cavity extending in the direction of an insertion axis for receiving an associated plug pin in an electrical plug-and-socket device, in particular for the production of a contact sleeve according to one of the afore-described embodiments. The method includes the following steps:

Drilling and/or milling a cavity, which extends along an insertion axis and tapers towards the distal end, in a (preferably substantially rod-shaped) raw material;

Insertion of slots extending in the direction of the insertion axis for exposing contact fingers around the cavity.

Typically, the first step of the method starts by making a (circular cylindrical) bore, with the radius of this bore being slightly smaller than the radius of the plug pin (see above) associated with the contact sleeve. Furthermore, the depth of the bore can, optionally, be made greater than the length required for receiving a plug pin. In a next sub-step, the radius of the bore can then be widened at its proximal end thereof by milling such as to establish the desired tapering shape of the cavity, in particular a cone shape. The method is able to produce a contact sleeve with inwardly inclined contact fingers in the grown material.

BRIEF DESCRIPTION OF THE DRAWING

The invention will be explained in more detail hereinafter by way of example with reference to the figures. It is shown in.

DETAILED DESCRIPTION OF PREFERRED EMBODIMENTS

Figure 1:
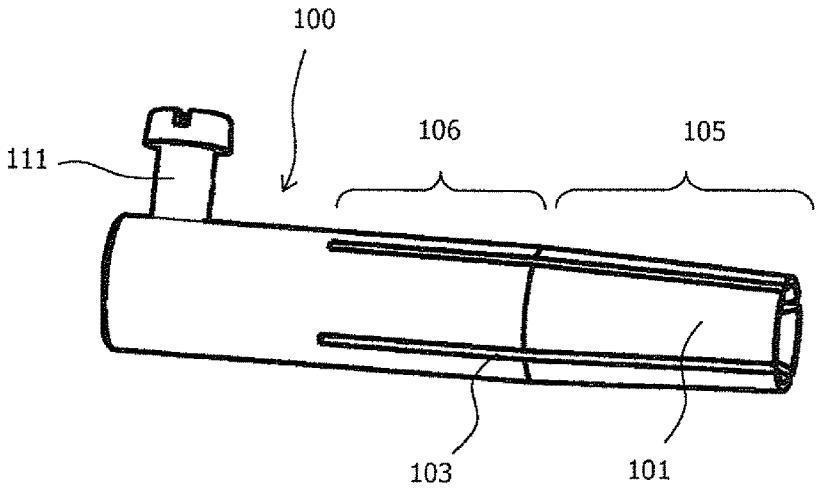
FIG. 1 a perspective view of a contact sleeve according to a first embodiment.
Figure 2:
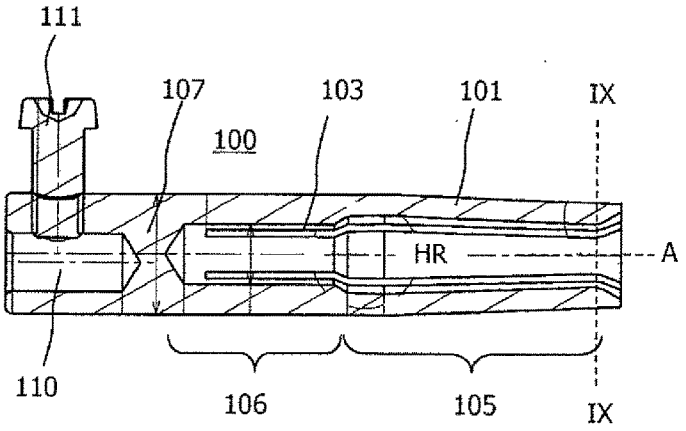
FIG. 2 a longitudinal section through the contact sleeve of FIG. 1.
Figure 3:
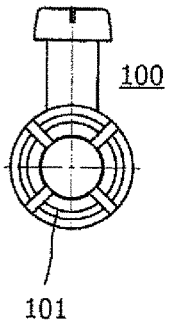
FIG. 3 a view of the front side of the contact sleeve of FIG. 1.

FIGS. 1 to 3 show a first embodiment of a contact sleeve 100 according to the invention. The contact sleeve 100 is used in a not shown coupling or socket of an electrical plug-and-socket device to establish electrical contact with an associated (normally circular-cylindrical) plug pin.

For this purpose, the contact sleeve is made of an electrically conductive material, for example a metal such as copper or brass, and has a cavity HR, which extends along an insertion axis A and into which the plug pin can be inserted. The cavity HR is formed by two or more contact fingers 101 (in the illustrated example, four), which extend parallel to one another and are arranged on a circle around the insertion axis A.

As can be seen from FIG. 2, the contact fingers 101 are shaped in such a way that they surround a plug-in region 105 in the form of a cone or truncated cone, in which the plug pin rests, when the plug-and-socket device is plugged together. The cone is oriented hereby in such a way that the cavity HR tapers towards the distal end of the contact sleeve (i.e., towards the plug-in opening, on the right-hand side in FIG. 2). The angle of inclination of the cone is typically between approx. 0.5° and approx. 3° relative to the insertion axis A.

The narrowest radius of the cavity HR in the region of the plug-in opening (which preferably has a funnel-shaped widening towards the outside so as to facilitate the insertion of a plug pin) is preferably approx. 10% smaller than the nominal radius of the associated plug pin. When inserting the plug pin, the contact fingers 101 must therefore move outwards and enlarge the cavity HR accordingly. This movement takes place under an elastic counterforce, which in turn provides the required contact pressure between contact sleeve and plug pin.

As is further apparent from FIG. 2, the cavity HR extends beyond the plug-in region 105 even deeper into the contact sleeve. This deeper bottom region 106 is no longer reached by the plug pin and is intended only to impart the desired elastic properties to the contact fingers 101. In this regard, it can be seen that the contact fingers 101 have a variable thickness along their axial extent. In the bottom region 106, they are thicker than in the plug-in region 105, with the wall thickness being uniform in the plug-in region 105, since the outer contour extends in correspondence to the inner side of the contact finger 101 is the shape of a cone.

The contact fingers 101 extend from a carrier body 107, in which a connection 110 is arranged on the side opposite the contact fingers, for insertion of an electric connecting line (not shown), with this line being able to be secured by a transverse screw 111.

The production of the contact sleeve 100 is preferably realized from a raw material without bending processes. Initially, a rod-shaped blank (from "grown material") is provided axially with a first circular cylindrical bore having a small radius ($R_F$, see FIG. 9), with this radius typically corresponding to the radius of the bottom region 106 or because of the nature of the manufacture can deviate therefrom by few 1/10 mm. Starting from the thus-created free space, a conical shape is subsequently machined by milling into the plug-in region 105 of the cavity HR. A corresponding outer cone may, optionally, be machined by turning.

After completion of the milling of the cavity HR, radial cuts (along plug-in region 105 and bottom region 106) produce slots 103 to expose the desired number of contact fingers 101.

Compared to a production process in which contact fingers are first exposed and then bent into a circular cylindrical bore in order to realize a conical shape, the described method has the advantage of realizing a better elastic behavior by the absence of bends.

Figure 9:
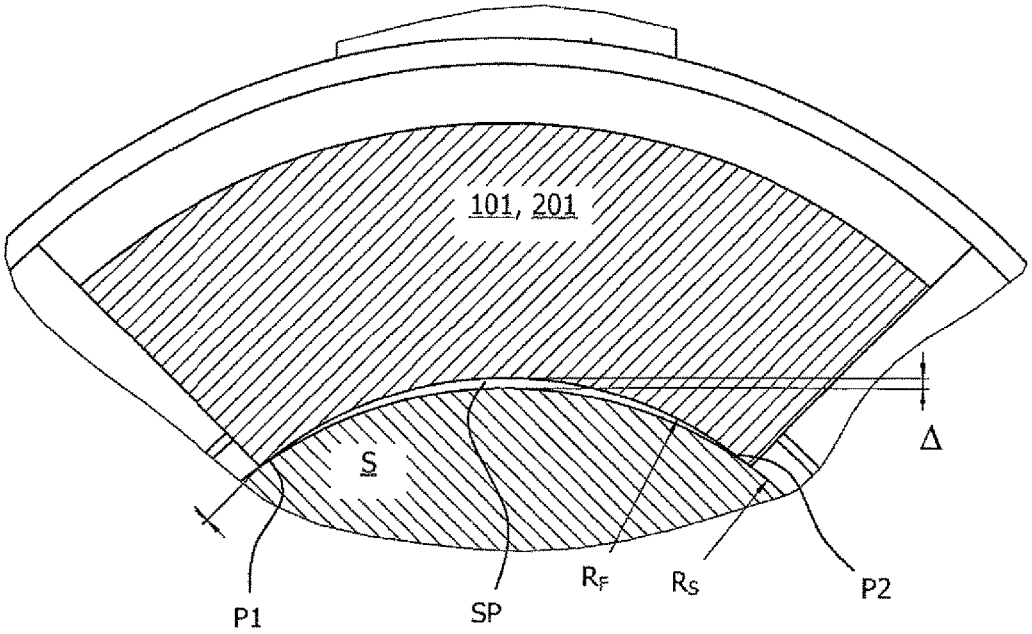
FIG. 9 a cross section taken along the line IX-IX of FIG. 2 through the contact area between a contact finger and a plug pin.

A further advantage of the above-described production method will be explained hereinafter in more detail with the assistance of FIG. 9. As is apparent from the radial section through a contact finger 101 (or 201) and a plug pin S, the contact finger 101 (in the distal plug-in region 105, the section runs at the narrowest distal position, i.e. along the line IX-IX of FIG. 2) has a cone-shaped (or more precisely frustoconical) inner side with a radius $R_F$. According to FIG. 2, this is the smallest radius which occurs in the plug-in region 105. Due to the manufacturing process, this radius is smaller than the nominal radius $R_S$ of the corresponding plug pin S (for example $R_F$=4.50 mm, $R_S$=4.97 mm). As a consequence of this difference, the contact fingers 101 rests (viewed in radial section) only at the ends of the contact surface in two points P1 and P2 upon the plug pin surface, with these points being separated by a gap SP of typically Δ=0.12 mm width.

In addition to improved mechanical and electrical contact properties, the contact in two points (or lines) per contact finger 101 has a further advantage, when the contact surface of the contact fingers is coated with a metal such as for example nickel (Ni) and/or silver (Ag) (typically the contact finger is made of brass, which is provided with a layer of Ni and above it Ag). When over time friction causes a material abrasion at the contact points P1 and P2, the contact points move toward one another and consume the gap SP. This ensures that the contact between contact finger and plug pin is constantly realized via "fresh" coating material, which is effectively stored in the region of the gap.

FIGS. 4 to 8 show a second embodiment of a contact sleeve 200 according to the invention. The contact sleeve 200 is formed in essential aspects the same as the first contact sleeve 100 of FIGS. 1 to 3, wherein corresponding components are provided with reference signs which are increased by 100 and need not be explained again. The contact sleeve 200, for example, has again a conical cavity HR and is preferably produced without bends.

A significant innovation of the second contact sleeve 200 are depressions 202 which are formed in the distal initial area of the cavity HR on the inner side of the contact fingers 201. In the illustrated example, the depressions 202 are configured, in particular, in the form of four annularly circumferential grooves, with these grooves being incorporated into the inner side of the contact fingers 201 as sharp-edged as possible.

Figure 8:
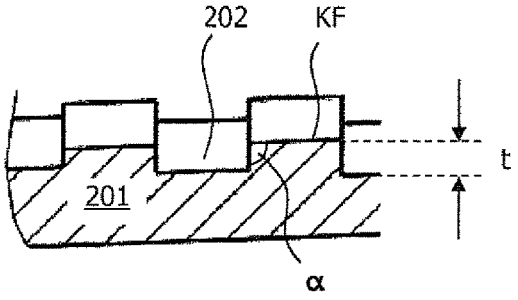
FIG. 8 a detailed view of a depression of the contact sleeve of FIG. 4.

FIG. 8 shows in this respect, by way of enlarged illustration, a depression 202 having an edge which defines towards the contact surface KF on the inner side of the contact finger 201 an edge angle α of typically approx. 90°. The depth t of the grooves can be, for example, between approx. 0.2 and approx. 1 mm (Note: Belonging, by definition, to the contact surface shall be any point which comes in to contact with a plug pin or comes closer to the plug pin than a predefined distance of, for example, less than 50% of the groove depth t).

Figure 4:
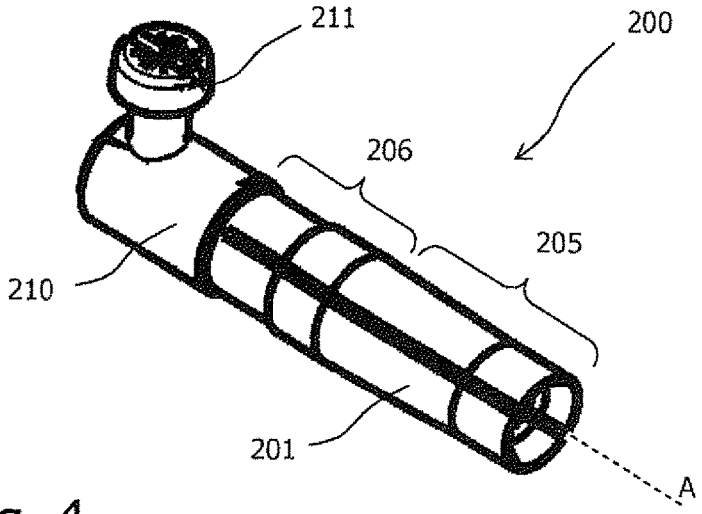
FIG. 4 a perspective view of a contact sleeve according to a second embodiment which has depressions on its inner side.
Figure 5:
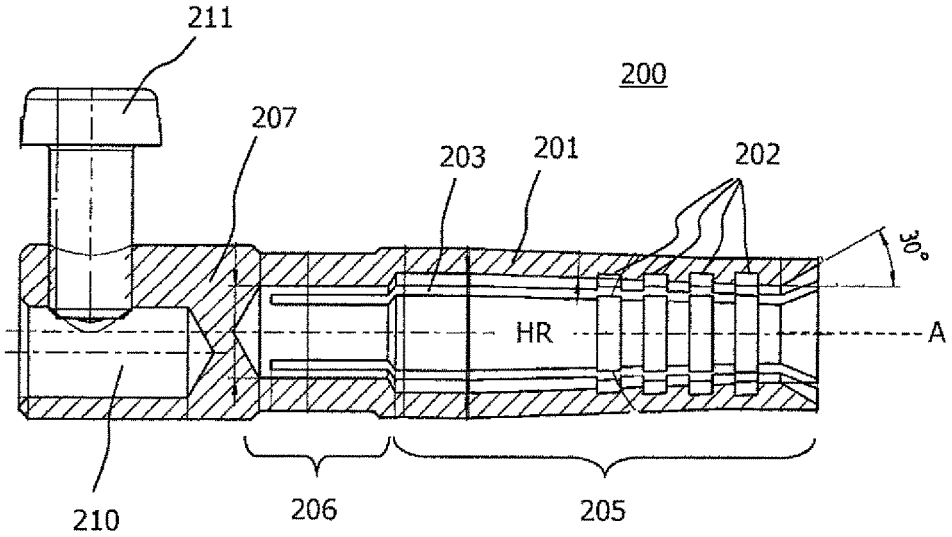
FIG. 5 a longitudinal section through the contact sleeve of FIG. 4.
Figure 6:
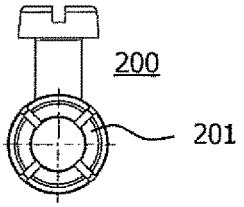
FIG. 6 a view of the front side of the contact sleeve of FIG. 4.
Figure 7:
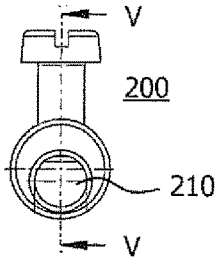
FIG. 7 a view of the rear side of the contact sleeve of FIG. 4.

FIGS. 4 and 5 further show that the contact sleeve 200 has an outer constriction in the bottom region 206 so that the contact fingers 201 have a desired thickness and thus a desired spring behavior.

While the figures show freestanding contact fingers 101, 201, the contact fingers could, optionally, also be surrounded in the distal region (105, 205) on the outside by an elastic spring ring (not shown) to increase the radially inward pressure upon an inserted plug pin.

The invention claimed is:

1. A plug-and-socket device, comprising:

a plug pin; and a contact sleeve having a cavity extending in a direction of an insertion axis for receiving the plug pin, said contact sleeve including at least two contact fingers arranged in parallel relationship to one another around the cavity and configured to move elastically apart while expanding the cavity when the plug pin is inserted, at least one of the at least two contact fingers being formed on an inner side in facing relation to the cavity with a plurality of depressions which lie in a contact surface on the inner side and define with the contact surface an edge angle of less than approx. 100°, each depression having a beginning and an end with respect to the direction of an insertion axis, said contact surface representing on the inner side of the contact finger a surface which comes into contact with the plug pin, when the plug pin is inserted, and said contact surface bordering both the end and the beginning of each said depression with respect to the direction of the insertion axis.

2. The plug-and-socket device of claim 1, wherein the edge angle is less than approx. 91°.

3. The plug-and-socket device of claim 1, wherein the plurality of depressions are arranged in a distal half of the cavity.

4. The plug-and-socket device of claim 1, wherein the plurality of depressions are sized to cover between approx. 20% and approx. 80% of an area of the inner side of the contact finger.

5. The plug-and-socket device of claim 1, wherein the plurality of depressions are sized sized to cover between approx. 30% and approx. 70% of an area of the inner side of the contact finger.

6. The plug-and-socket device of claim 1, wherein each of the at least two contact fingers includes a respective depression of said plurality of depressions such that the respective depression on one of the contact fingers and the respective depression on the other one of the contact fingers jointly form a groove which surrounds the insertion axis.

7. The plug-and-socket device of claim 1, wherein at least one of the at least two contact fingers contacts the plug pin in a section perpendicular to the insertion axis at two points which are separated by a gap between the plug pin and the one of the at least two contact fingers.

8. The plug-and-socket device of claim 1, wherein the contact surface on the inner side of the at least one of the at least two contact fingers is of circular-cylindrical or frustoconical shape defined by a radius which is smaller than a radius of the plug pin.

9. The plug-and-socket device of claim 1, wherein the inner side of each of the at least two contact fingers is coated at least on the contact surface of each of the at least two contact fingers.

10. The plug-and-socket device of claim 9, wherein the inner side of each of the at least two contact fingers is coated with nickel and/or silver.

11. The plug-and-socket device of claim 1, wherein the cavity is configured to taper towards a distal end of the contact sleeve, said contact sleeve including a carrier body to carry the at least two contact fingers, said at least two contact fingers and the carrier body being produced from a raw material without bends.

* * * * *